US012492498B2

(12) United States Patent
Lee et al.

(10) Patent No.: US 12,492,498 B2
(45) Date of Patent: Dec. 9, 2025

(54) LAUNDRY TREATING APPARATUS

(71) Applicant: LG ELECTRONICS INC., Seoul (KR)

(72) Inventors: Jihong Lee, Seoul (KR); Minkyu Sang, Seoul (KR); Jihun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 410 days.

(21) Appl. No.: 17/926,060

(22) PCT Filed: May 18, 2021

(86) PCT No.: PCT/KR2021/006247
§ 371 (c)(1),
(2) Date: Nov. 17, 2022

(87) PCT Pub. No.: WO2021/235847
PCT Pub. Date: Nov. 25, 2021

(65) Prior Publication Data

US 2023/0183901 A1 Jun. 15, 2023

(30) Foreign Application Priority Data

May 18, 2020 (KR) ..... 10-2020-0059025

(51) Int. Cl.
*D06F 21/04* (2006.01)
*D06F 37/22* (2006.01)
(Continued)

(52) U.S. Cl.
CPC ..... *D06F 21/04* (2013.01); *D06F 37/22* (2013.01); *D06F 37/26* (2013.01); *D06F 23/04* (2013.01); *D06F 31/00* (2013.01); *D06F 39/12* (2013.01)

(58) Field of Classification Search
CPC ..... D06F 37/22; D06F 37/26; D06F 21/04; D06F 39/12; D06F 23/04; D06F 31/00
See application file for complete search history.

(56) References Cited

U.S. PATENT DOCUMENTS 7,874,185 B2 1/2011 Graute et al.
9,631,312 B2 * 4/2017 Han ..... D06F 29/00
(Continued)

FOREIGN PATENT DOCUMENTS

CN 105624964 B 8/2019
CN 110791917 A 2/2020
(Continued)

*Primary Examiner* — Benjamin L Osterhout
(74) *Attorney, Agent, or Firm* — Birch, Stewart, Kolasch & Birch, LLP

(57) ABSTRACT

A laundry treating apparatus includes: a cabinet having an upper panel and a side panel extending downward from an edge of the upper panel; a tub disposed inside the cabinet; a drum rotatably disposed inside the tub; a driving part disposed under the tub, fixed to a bottom of the tub, and having a driving shaft penetrating through the bottom of the tub and fixed to the drum; and a front frame coupled to a front of the cabinet. The front frame includes: an upper frame extending in a left-right direction; a pair of support frames extending downward from left and right ends of the upper frame; and a lower frame extending along a longitudinal direction of the upper frame and coupled to the support frames at a position spaced upward from lower ends of the support frames.

18 Claims, 7 Drawing Sheets

(51) Int. Cl.

| | |
|---|---|
| ***D06F 37/26*** | (2006.01) |
| *D06F 23/04* | (2006.01) |
| *D06F 31/00* | (2006.01) |
| *D06F 39/12* | (2006.01) |

(56) References Cited

U.S. PATENT DOCUMENTS

| | | | | |
|---|---|---|---|---|
| 2011/0265524 | A1* | 11/2011 | Kim | D06F 39/08 68/13 R |
| 2017/0340106 | A1* | 11/2017 | Choi | D06F 39/14 |
| 2019/0194852 | A1* | 6/2019 | Lee | D06F 39/12 |

FOREIGN PATENT DOCUMENTS

| | | | | |
|---|---|---|---|---|
| EP | 2063012 | A1 * | 5/2009 | D06F 29/005 |
| EP | 2980296 | A1 * | 2/2016 | D06F 13/00 |
| EP | 3252197 | A1 * | 12/2017 | D06F 31/00 |
| EP | 3255198 | A1 * | 12/2017 | A47L 15/4214 |
| EP | 3366824 | A1 * | 8/2018 | A47L 15/4214 |
| EP | 3265599 | B1 * | 8/2019 | D06F 29/005 |
| EP | 3683351 | A1 * | 7/2020 | D06F 29/00 |
| JP | 11-156090 | A | 6/1999 | |
| KR | 20-0203886 | Y1 | 12/2000 | |
| KR | 10-0777278 | B1 | 11/2007 | |
| KR | 10-1461951 | B1 | 11/2014 | |
| WO | WO-2009134018 | A2 * | 11/2009 | D06F 29/00 |
| WO | WO-2017003182 | A1 * | 1/2017 | D06F 31/00 |
| WO | WO2020/085807 | A1 | 4/2020 | |
| WO | WO-2020085695 | A1 * | 4/2020 | D06F 31/00 |
| WO | WO-2020116859 | A1 * | 6/2020 | D06F 29/005 |
| WO | WO-2021235801 | A1 * | 11/2021 | D06F 23/04 |

* cited by examiner (b)

(a)

LAUNDRY TREATING APPARATUS

CROSS REFERENCE TO RELATED APPLICATIONS

This application is the National Phase of PCT International Application No. PCT/KR2021/006247, filed on May 18, 2021, which claims priority under 35 U.S.C. 119(a) to Patent Application No. 10-2020-0059025, filed in the Republic of Korea on May 18, 2020, all of which are hereby expressly incorporated by reference into the present application.

BACKGROUND

Field of the Invention

The present disclosure relates to a laundry treating apparatus.

Related Art

In general, a laundry treating apparatus is a concept including an apparatus for washing clothes (an object to wash, an object to dry), an apparatus for drying clothes, and an apparatus for performing washing and drying of clothes.

Such a laundry treating apparatus performs washing and/or drying by rotating a drum disposed inside a tub. As the drum is rotated, the tub may vibrate, and the vibration of the tub may be transmitted to a cabinet.

Meanwhile, recently, in order to wash and/or dry a large amount of objects at a time, the capacity of the tub and the drum in the laundry treating apparatus is increasing.

If a small amount of objects is processed using a general laundry treating apparatus, it may lead to a waste of water and power consumption.

Accordingly, a laundry treating apparatus having a smaller size and a larger capacity than the general laundry treating apparatus has been developed.

Such a relatively small-sized laundry treating apparatus may be designed to have a width equal to or similar to that of the general laundry treating apparatus and a smaller height than that of the general laundry treating apparatus, and may be disposed on or under the general laundry treating apparatus.

The relatively small-sized laundry treating apparatus has a limit on the height of the cabinet for convenience of use, and has a limit on a width similar to that of the general laundry treating apparatus.

When the capacity of the tub and the drum is too small, the effectiveness of the small-sized laundry treating apparatus may be reduced due to the limitation of the size of the cabinet.

SUMMARY

An aspect of the present disclosure is to solve the above and other problems.

Another aspect of the present disclosure provides a laundry treating apparatus capable of reducing vibration of a tub and a cabinet due to the rotation of the drum.

Yet another aspect of the present disclosure provides a laundry treating apparatus capable of reducing vibrations in a left-right direction of a cabinet.

Yet another aspect of the present disclosure provides a laundry treating apparatus having a cabinet with high rigidity.

Yet another aspect of the present disclosure provides a laundry treating apparatus having a cabinet that is not deformable even by an external force in a left-right direction.

Yet another aspect of the present disclosure provides a laundry treating apparatus capable of increasing of a volume of a tub.

Yet another aspect of the present disclosure provides a laundry treating apparatus capable of increasing of a volume of a tub positioned inside a cabinet and/or drawer whose width is set longer than a height.

Yet another aspect of the present disclosure provides a laundry treating apparatus in which an opening through which a drawer is pulled out is formed by a plurality of frames.

Yet another aspect of the present disclosure provides a laundry treating apparatus for enabling expansion of a width or height of the opening as a plurality of frames forming the opening is provided.

Yet another aspect of the present disclosure provides a laundry treating apparatus in which a range in which the opening is expanded may exceed a molding range of a single material.

Yet another aspect of the present disclosure provides a laundry treating apparatus in which a plurality of frames forming the opening is coupled to each other by being received or inserted, so that a separate fastening member or the like can be omitted.

Yet another aspect of the present disclosure provides a laundry treating apparatus capable of increasing of a washing capacity of a clothing accommodating part accommodated in a drawer by increasing a volume of the drawer.

Yet another aspect of the present disclosure provides a laundry treating apparatus in which a front frame forming the opening is capable of attenuating vibration and noise.

In an aspect, there is provided a laundry treating apparatus,

The laundry treating apparatus of the present disclosure includes a cabinet, a tub disposed inside the cabinet, and a front frame (hereinafter, also referred to as a "pull-out frame") coupled to the cabinet.

The cabinet may have a upper panel and a side panel. The side panel may extend downward from an edge of the upper panel.

The front frame may include an upper frame (hereinafter also referred to as a "main frame"), a pair of support frames extending from the upper frame, and a lower frame (hereinafter also referred to as an "extension frame") coupled to the support frame.

The upper frame may extend in a left-right direction.

The support frame may extend downward from the upper frame. The pair of support frames may extend downward from left and right ends of the upper frame. The pair of support frames may include a left frame extending downward from the left end of the upper frame and a right frame extending downward from the right end of the upper frame.

The lower frame may extend along a longitudinal direction of the upper frame. The lower frame may include a portion spaced upwardly from a lower end of the support frame. The lower frame may be coupled to the support frame at a position spaced upward from the lower end of the support frame.

The front frame may further include an extension frame (hereinafter, also referred to as an "extension panel") extending from the lower end of the support frame toward a center of the front frame in the left-right direction.

A separation space may be formed between the lower frame and the extension frame.

The laundry treating apparatus may further include an extension rib (hereinafter, also referred to as a "bent rib") extending upward from front and rear edges of the extension frame.

The lower frame may be coupled to the extension rib.

The laundry treating apparatus may further include: a seating groove recessed downward from the extension rib; and a support protrusion protruding from the lower frame and inserted into the seating groove.

The laundry treating apparatus may further include: an insertion hole formed in the support frame and spaced apart from the lower end of the support frame upward; and an insertion protrusion protruding from the lower frame and inserted into the insertion hole.

The laundry treating apparatus may further include a receiving groove recessed from an outer surface of the support frame and disposed below the insertion hole.

The insertion protrusion may extend downward and be disposed in the receiving groove.

The laundry treating apparatus may further include a reinforcement bead extending along a longitudinal direction of the lower frame.

The lower frame may include an inclined part inclined downward toward a center of the front frame in the left-right direction.

The lower frame may further include an expansion part extending in the longitudinal direction of the lower frame from the inclined part.

The laundry treating apparatus may further include a pair of support legs positioned under the cabinet.

The expansion part may be positioned between the pair of support legs in the left-right direction.

The laundry treating apparatus may include a drum disposed inside the tub. The drum may be rotatably disposed inside the tub.

The laundry treating apparatus may include a driving part for rotating the drum.

The driving part may be disposed under the tub. The driving part may be fixed to a bottom of the tub. The driving part may include a driving shaft.

The driving shaft may pass through the bottom of the tub. The drive shaft may be fixed to the drum.

The laundry treating apparatus may further include a drawer disposed inside the cabinet.

The drawer may be able to be pulled out through an opening defined by the front frame. The drawer may accommodate the tub. The drawer may accommodate the driving part.

The laundry treating apparatus may further include an avoiding groove recessed downward from the lower frame and disposed at a position corresponding to the driving shaft in the left-right direction.

The laundry treating apparatus of the present disclosure may include a pull-out frame, which forms a front of a cabinet or an opening and is provided by coupling a plurality of frames.

Accordingly, as a frame structure can be applied by mixing an easily deformable material and a high-rigidity material, it is possible to selectively expand an area of an opening.

In addition, when the frame structure is integrally provided, a degree of plastic deformation is limited. Thus, in the laundry treating apparatus of the present disclosure, even when each frame is made of one material, a lower frame and a other frames may be separately manufactured and then the frames may be coupled to each other, thereby securing a maximum amount of plastic deformation.

In addition, in the laundry treating apparatus according to the present disclosure, the pull-out frame may be provided by coupling a plurality of frames to each other, thereby securing an internal space that cannot be manufactured when pull-out frame is integrally formed. The space may induce durability of the pull-out frame even when an external force acts on the frame due to pulling in and out of the drawer or vibration inside the tub.

In addition, in the laundry treating apparatus of the present disclosure, the pull-out frame may be fixed and assembled without a separate fastening member by fitting and receiving manners.

In addition, in the laundry treating apparatus of the present disclosure, a bottom surface of a cabinet may be coupled by a frame, thereby removing a conventional lower panel to further secure heat dissipation performance of a driving part.

Specifically, in order to solve the above problems, a laundry treating apparatus according to the present disclosure includes a cabinet having an opening in the front, a drawer accommodated in the cabinet and able of being pulled out through the opening, and a clothing accommodating part provided inside the drawer to accommodate clothes.

The cabinet may include a main body forming a space for accommodating the drawer, a fixed frame covering a rear of the main body, and a pull-out frame coupled to a front of the main body to form the opening.

The pull-out frame may include a support frame coupled to both sides of the main body, a main frame provided to connect upper ends of both sides of the support frame, and an expansion frame coupled to lower ends of both sides of the support frame.

The pull-out frame may include seating portions respectively extending from lower ends of both sides of the support frame, so that both ends of the expansion frame can be seated.

The pull-out frame may further include a seating portion extending from lower portions of both sides of the support frame and coupled to the expansion frame, and the expansion frame may be at least partially spaced apart from the seating portion to form a space A together with the seating portions.

The expansion frame may be seated on a top of the seating portion to form the separation space A.

The seating portion may include an extension panel extending from a bottom of the support frame, and bent ribs bent upward from both sides of the extension panel to provide a space in which the expansion frame is installed.

The expansion frame may be coupled to the bent ribs and spaced apart from the extension panel to form the separation space A.

The expansion frame may be fixed and coupled to the inside of the bent ribs.

The expansion frame may include a seating body disposed inside the bent ribs, and a support protrusion extending from at least one of both side surfaces the seating body and seated on or coupled to the ben ribs so that the seating body is spaced apart from the extension panel to form the separation space A.

The expansion frame may include an insertion protrusion extending from the seating body to fix the seating body, and the support frame may include an insertion hole through which the insertion protrusion is inserted to be coupled.

The insertion hole may be spaced apart above the seating portion, so that the seating body is spaced apart from the extension panel to form the separation space A.

The support frame may include a reinforcement panel coupled to the main body in contact with the main body, and a support panel extending from the reinforcement panel and exposed to the outside to form the insertion hole.

The support panel may include a receiving groove recessed inward from one side of the insertion hole to accommodate a free end of the insertion protrusion.

The seating portion may include an expansion panel bent downward from the extension panel, and the expansion frame may include an inclined body extending obliquely from the seating body toward the expansion panel, and an expansion body extending from the inclined body to face the main frame.

The inclined body may extend obliquely from the seating body to the extension panel or a distance spaced apart from the expansion panel.

The seating portion may include a seating panel extending from the expansion panel, and at least one of the inclined body and the expansion body may be coupled to the seating panel by welding or a fastening member and fixed thereto.

The clothing accommodating part may further include a driving part provided under the clothing accommodating part to rotate the clothing accommodating part, and the expansion body may include an avoiding groove provided to avoid the driving part or a lowermost end of the drawer.

The bent ribs may extend to both sides of the expansion panel to fix the inclined body.

A height of a bent rib provided in the extension panel may be higher than a height of a bent rib provided in the expansion panel.

At least one of the seating body, the inclined body, and the expansion body may include a reinforcement bead protruding or recessed to reinforce rigidity.

The reinforcement bead may extend in a longitudinal direction of the inclined body and the expansion body.

The reinforcement bead may be provided in plural such that a plurality of reinforcement beads is spaced apart from each other by a predetermined distance along a thickness direction of the inclined body and the expansion body.

The clothing accommodating part may further include a driving part provided under the clothing accommodating part to rotate the clothing accommodating part. The cabinet may further include a lower panel coupled to a bottom of the main body to shield the bottom of the cabinet, and the lower panel may include an open hole for exposing the driving part or discharging heat generated from the driving part.

A driving part for rotating the clothes receiving part may be provided under the clothing accommodating part, and the cabinet may include a lower frame which is coupled to a lower corner of one side of the main body and a lower corner of the other side of the main body facing the one side.

The lower frame may be provided with a thickness that can prevent overlapping with the bottom of the driving part.

The lower frame may include: a frame body coupled to or brought into contact with any one of a lower end of the main body, the pull-out frame, and the fixed frame; and a frame bead provided concave or convex inside the frame body to reinforce the rigidity of the frame body.

The lower frame may be coupled in a direction from the front to the rear of the main body.

According to at least one of the embodiments of the present disclosure, it is possible to provide a laundry treating apparatus capable of reducing vibration of a tub and a cabinet due to rotation of a drum.

According to at least one of the embodiments of the present disclosure, it is possible to provide a laundry treating apparatus capable of reducing vibration in a left-right direction of a cabinet.

According to at least one of the embodiments of the present disclosure, it is possible to provide a laundry treating apparatus having a strong cabinet.

According to at least one of the embodiments of the present disclosure, it is possible to provide a laundry treating apparatus including a cabinet that is not deformed even by an external force in a left-right direction.

According to at least one of the embodiments of the present disclosure, it is possible to provide a laundry treating apparatus capable of increasing a volume of a tub.

According to at least one of the embodiments of the present disclosure, it is possible to provide a laundry treating apparatus capable of increasing a volume of a tub positioned inside a cabinet and/or drawer whose width is set longer than a height.

According to at least one of the embodiments of the present disclosure, there is an effect that an opening through which a drawer can be pulled out may be formed by a plurality of frames.

According to at least one of the embodiments of the present disclosure, there is an effect that a width or height of the opening may be expanded as a plurality of frames forming the opening is provided.

According to at least one of the embodiments of the present disclosure, there is an effect that a range of expanding the opening may exceed a molding range of a single material.

According to at least one of the embodiments of the present disclosure, there is an effect that a separate fastening member and the like may be omitted since a plurality of frames forming the opening is coupled in a receiving or inserting manner.

According to at least one of the embodiments of the present disclosure, it is possible to increase a washing capacity of a clothing accommodating part accommodated in a drawer by increasing a volume of the drawer.

According to at least one of the embodiments of the present disclosure, it is possible to provide a laundry treating apparatus in which a front frame forming the opening is capable of attenuating vibration and noise.

DESCRIPTION OF EXEMPLARY EMBODIMENTS

Figure 1:
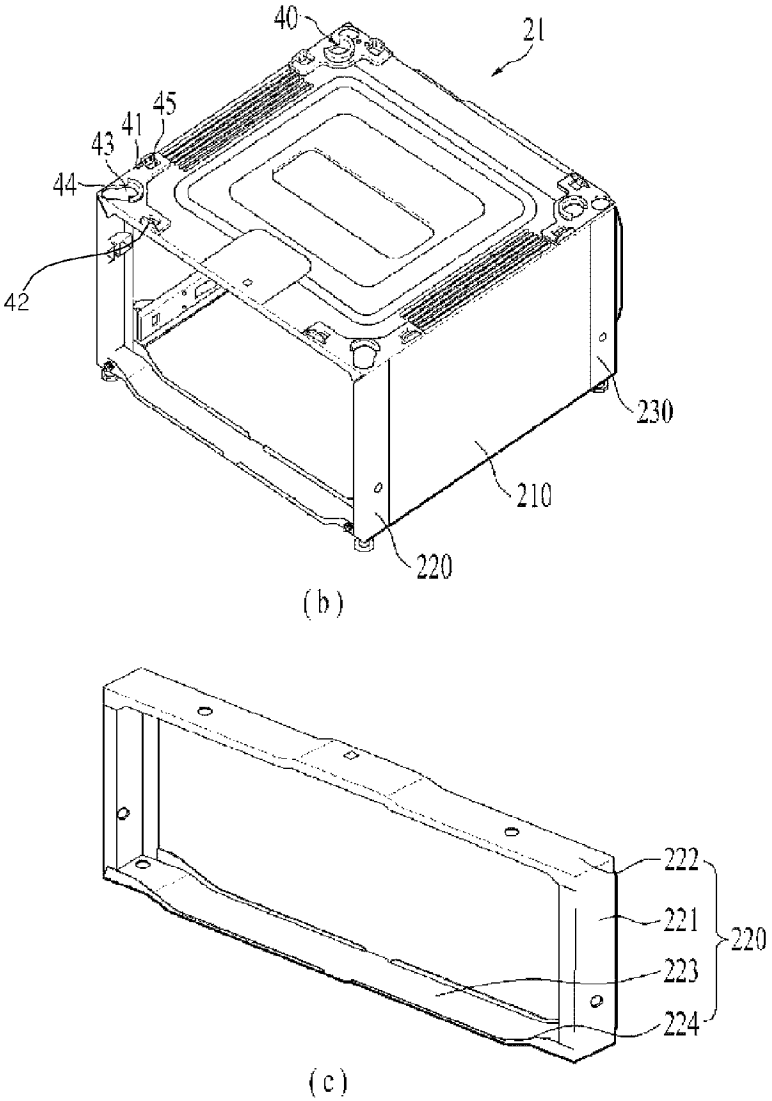
FIG. 1 shows an example of a laundry treating apparatus.
Figure 1:
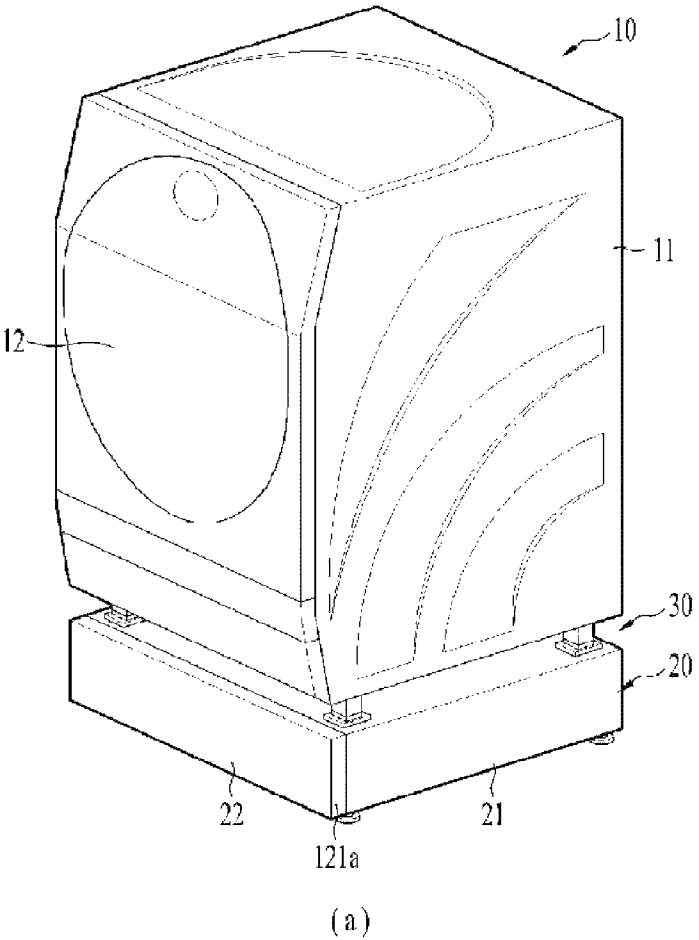

Hereinafter, embodiments disclosed herein will be described in detail with reference to the accompanying drawings. Regardless of the reference numerals, the same or similar components are assigned the same reference numerals, and overlapping descriptions thereof will be omitted.

The suffixes "module" and "part" for components used in the following description are given or mixed in consideration of only the ease of writing the specification, and do not have distinct meanings or roles by themselves.

In addition, in describing the embodiments disclosed in the present specification, if it is determined that detailed descriptions of related known technologies may obscure the gist of the embodiments disclosed in this specification, the detailed description thereof will be omitted. In addition, the accompanying drawings are only for easy understanding of the embodiments disclosed in the present specification, and the technical spirit disclosed in the present specification is not limited by the accompanying drawings, and all changes included in the spirit and scope of the present disclosure, should be understood to include equivalents or substitutes.

Terms including ordinal numbers such as first, second, etc. may be used to describe various elements, but the elements are not limited by the terms. The above terms are used only for the purpose of distinguishing one component from another.

When a component is referred to as being "connected" or "connected" to another component, it may be directly connected or connected to the other component, but it is understood that other components may exist in between. it should be On the other hand when it is said that a certain element is "directly connected" or "directly connected" to another element, it should be understood that the other element does not exist in the middle.

The singular expression includes the plural expression unless the context clearly dictates otherwise.

FIG. 1 schematically shows an exterior, a second cabinet 21, and a front frame 220 of a laundry treating apparatus according to an embodiment of the present disclosure.

Referring to FIG. 1(*a*), in the laundry treating apparatus, a first treatment unit 10 is provided as a front load type, and a second treatment unit 20 is provided as a drawer type and a top load type. Thus, even if the first treatment unit 10 is provided at an upper position, a user can sufficiently access a door 12 provided at the first treatment unit 10, and even if the second treatment unit 20 is provided at a lower position, the user may access the clothing accommodating part provided inside the second treatment unit 20.

The first treatment unit 10 may include a first cabinet 11 forming an exterior thereof and provided with the door 12 at the front, and may include a plurality of legs 30 provided at a bottom to support the first cabinet 11.

The second treatment unit 20 may include a second cabinet 21 forming an exterior thereof and supporting the first treatment unit 10, and a drawer to be pulled out forward from the second cabinet 21 and capable of accommodating clothes, and a bracket 40 capable of supporting the legs of the first treatment unit 10 may be installed at a top of the second cabinet 21 (see FIG. 1(*b*)).

Referring to FIG. 1(*b*), the second cabinet 21 may include a body cabinet 210 forming a main body, a front frame 220 coupled to a front of the body cabinet 210 to form an opening through which the drawer 22 is pulled in and out, and a rear frame 230 coupled to a rear of the body cabinet 210 to cover the rest of the body cabinet 210.

The front frame 220 and the rear frame 230 may extend from the body cabinet 210 to be coupled to each other. However, unlike the drawings, the front frame 220 and the rear frame 230 may be coupled to the inside of the body cabinet 210. Accordingly, the rigidity of the front frame 220 may be further reinforced.

The front frame 220 and the rear frame 230 have C-shaped cross-sections, thereby structurally superior in rigidity and durability compared to the body cabinet 210. The bracket 40 may be disposed at a location corresponding to each corner of the top of the body cabinet 210. For example, the bracket 40 may be disposed on both sides of the front frame 220 and on both sides of the rear frame 230.

The bracket 40 may include a bracket body 41 seated on a top of the second cabinet 21, a protruding plate 42 protruding from an outer circumferential surface of the bracket body 41, and a leg receiving hole 43 penetrating through the bracket body 41 to receive the leg 30. In addition, considering that a size of the first cabinet 11 seated on the top of the second cabinet 21 may change, the bracket 40 may further an auxiliary hole 44 extending in a diagonal direction from the leg receiving hole 43 to receive a leg of a first cabinet having a different size. In addition, a detection hole 45 in which a switch for detecting the first cabinet 11 being seated in the second cabinet 21 can be installed may also be installed in the bracket 40.

Referring to FIG. 1(*c*), the front frame 220 may include a load frame 221 coupled to both side surfaces of the body cabinet 210, an upper frame 222 provided to connect an upper end of the load frame 221, and a lower frame 223 facing the upper frame to connect a lower end of the load frame 221.

If the respective components of the front frame 220 are integrally formed, an assembly or welding process of each frame may be omitted.

Meanwhile, even if the second treatment unit 20 is provided as an auxiliary laundry treating apparatus, it is necessary to secure a washing capacity equal to or greater than a certain level, and an area formed by the opening of the front frame 220 needs to be enlarged in order to install a balancer or the like therein.

This is because the area formed by the opening determines a shape and a volume of the drawer 22, and the drawer 22 determines a washing capacity.

When the load frame 221 is extended to enlarge the opening, there is a problem in that not just the overall shape of the body cabinet 210 is changed, but also an installation height of the first treatment unit 11 is also changed.

Since the legs 121*a* may be installed at the bottom of the front frame 220, there is room for the lower frame 223 to be bent relatively further downward.

An extension bent portion 224 may be bent further downward than both ends of the lower frame 223 to enlarge the opening formed by the front frame 220 and also increase a height of the drawer 22 which is to be pulled in and out through the opening.

However, there is a limitation in that the extension bent portion 224 cannot be bent over a predetermined length or angle greater than as molded in the lower frame 223.

Since the extension bent portion 224 has no choice but to be formed within a plastic deformation range in which a material of the lower frame 223 may not be damaged, there is a limitation that a maximum level at which the opening of the front frame 220 can be enlarged is determined.

Thus, when the front frame 220 is molded as a single member, a volume of the clothing accommodating part accommodated in the drawer 22 may not be increased to or beyond an expected value, and a balancer for attenuating vibration of the clothing accommodating part and a volume or structure of a suspension supporting the clothing accommodating part may be limited.

Meanwhile, the extension bent portion 224 and the lower frame 223 of the front frame 220 may receive a load, a vibration, and noise. In this case, when the extension bent portion 224 and the lower frame 223 are spaced apart from the ground due to a leg, etc., the entire load transferred to the extension bent portion 224 and the lower frame 223 should be supported, which may lead to a durability issue.

In addition, the extension bent portion 224 and the lower frame 223 may vibration without attenuating the transmitted vibration, which may cause vibration and noise to propagate to the outside of the laundry treating apparatus.

Hereinafter, a laundry treating apparatus according to an embodiment of the present disclosure will be described in detail with reference to FIGS. 2 to 7.

Figure 2:
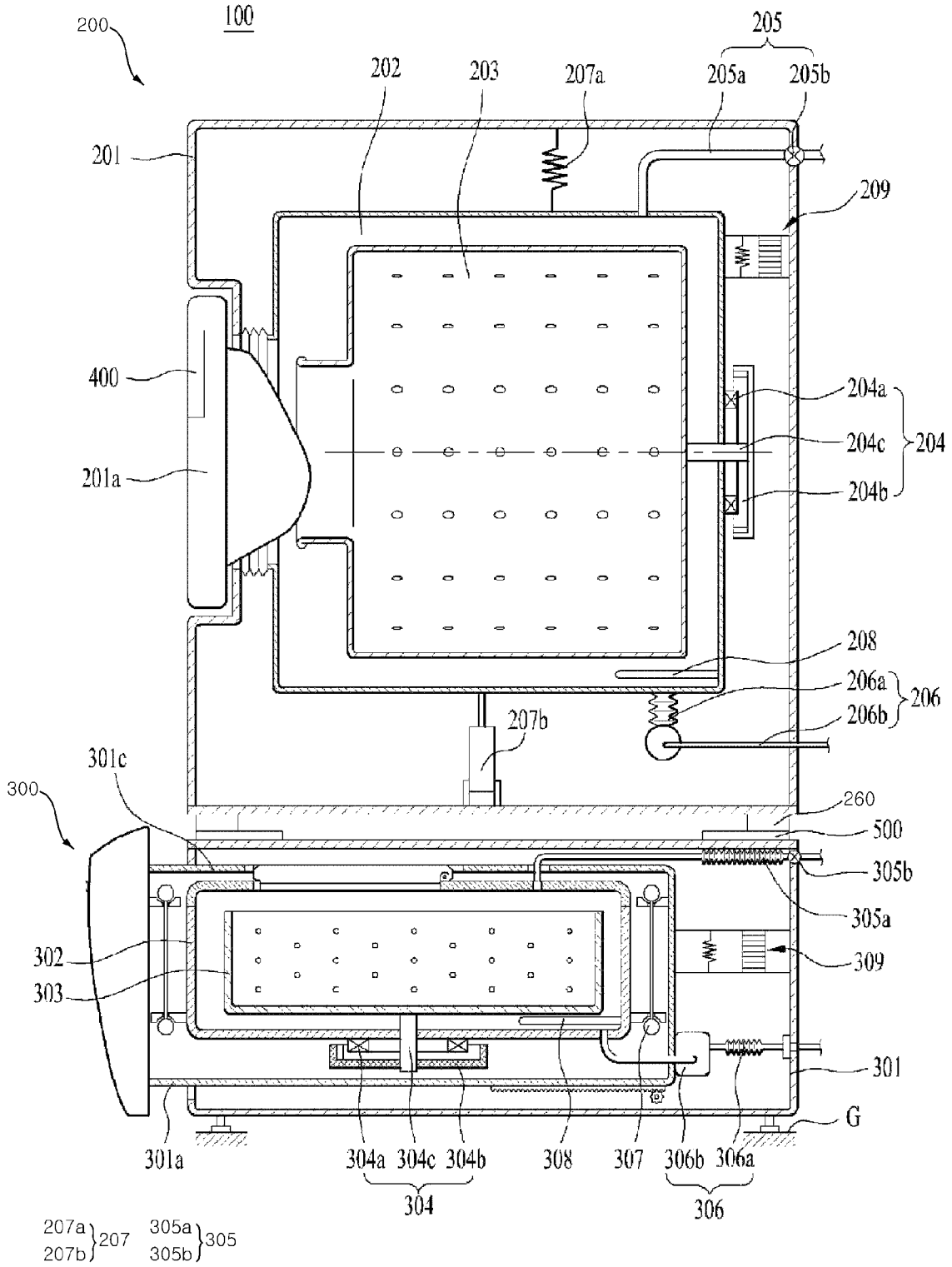
FIG. 2 illustrates a structure of a laundry treating apparatus according to the present disclosure.

FIG. 2 shows a laundry treating apparatus according to the present disclosure.

FIG. 2 shows a structure in which cabinets defining the exterior of treatment units for treating clothes according to the present disclosure are stacked in an up-down direction.

A laundry treating apparatus 100 according to the present disclosure may include a first treatment unit 200 serving as a main laundry treating apparatus and a second treatment unit 300 serving as an auxiliary laundry treating apparatus.

The first treatment unit 200 may be provided as a washing apparatus for performing a washing cycle to remove foreign substances from clothes, and may be provided as a drying apparatus for performing a drying cycle of drying clothes with moisture contained therein.

When the first treatment unit 200 is provided as a washing machine, the first treatment unit 200 may also perform the drying cycle for drying clothes.

The second treatment unit 300 may also be provided as a washing apparatus that performs a washing cycle to remove foreign substances from clothes, and may be provided as a drying apparatus that performs a drying cycle of drying clothes containing moisture.

When the second treatment unit 300 is provided as a washing machine, the second treatment unit 300 may also perform the drying cycle for drying clothes.

The first treatment unit 200 may have a larger washing or drying capacity than that of the second treatment unit 300. The first treatment unit 200 may be provided in a larger size than that of the second treatment unit 200.

The second treatment unit 300 may be provided as an auxiliary laundry treating apparatus for quickly washing or drying underwear, baby clothes, and a small amount of clothes while saving energy.

The second treatment unit 300 may be provided separately from the first treatment unit 200 but coupled to the first treatment unit 200.

A display part 400 for displaying the states of the first treatment unit 200 and the second treatment unit 300 and for receiving a command to control the first treatment unit 200 and the second treatment unit 300 to perform at least one of a washing cycle and a drying cycle may be provided.

When the second treatment unit 300 is provided separately from the first treatment unit 200, the first treatment unit 200 may include a first cabinet 201 forming an exterior thereof, and the second treatment unit 300 may include a second cabinet 301 forming an exterior thereof and provided separately from the first cabinet 201.

The second treatment unit 300 may be provided under the first treatment unit 200.

The first treatment unit 200 may be provided as a front-load type laundry treating apparatus, and the second treatment unit 300 may be provided as a top-load type laundry treating apparatus. The second treatment unit 300 may be provided as a drawer type.

Accordingly, the second treatment unit 300 may avoid interference with the first treatment unit 200.

Unlike the drawings, in the laundry treating apparatus of the present disclosure, the first treatment unit 200 may be disposed at a lower position and the second treatment unit 300 may be disposed at an upper position. That is, the second treatment unit 300 may be disposed at any position as long as serving as an auxiliary laundry treating apparatus of the first treatment unit 200.

In addition, the second treatment unit 300 may be provided independently of the first treatment unit 200. That is, the second treatment unit 300 may be provided as an independent laundry treating apparatus.

Hereinafter, for convenience of description, an embodiment in which the second treatment unit 300 is disposed under the first treatment unit 200 will be described. However, all or a part of the structure to be described below may be equally applied no matter where the second treatment unit 300 is disposed.

The second treatment unit 300 may include a drawer 301*a* to be pulled out forward from the inside of the second cabinet 301. The second treatment unit 300 may include a second clothing accommodating part 302 and 303 for accommodating clothes in the drawer 301*a*.

A seating leg 260 may be provided under the first cabinet 201 of the first treatment unit 200. The seating leg 260 may be provided in plural. The seating leg 260 may be disposed on the second treatment unit 300.

Meanwhile, in order to prevent the drawer 301*a* from being overturned when the drawer 301*a* is pulled out, the second treatment unit 300 may operate only when the first treatment unit 200 is seated thereon.

When the first treatment unit 200 and the second treatment unit 300 are provided as a washing machine, the first treatment unit 200 may include a first accommodating part 202 and 203 provided inside the cabinet 201 to accommodate clothes.

The first accommodating part 202 may include a first tub 202 for storing water, and a first drum 203 rotatably provided in the first tub 202 to accommodate clothes. A loading port through which clothes are loaded may be provided in the first drum 203 forward.

The first treatment unit 200 may include a first driving part 204 provided at one surface of the first tub 202 and rotating the first drum 203, a first water supply part 205 for supplying water to the first tub 202, and a first drain part 206 for draining water from the first tub 202.

The first driving part 204 may be attached to a rear surface of the first tub 202.

The first driving part 204 may include a first stator 204*a* forming a rotating magnetic field, a first rotor 204*b* rotatable by the rotating magnetic field, and a rotational shaft 204*c* connecting the rotor and one surface of the drum.

In addition, it is also possible for the first driving part 204 to include a motor provided on one side of the first tub 202, a rotational shaft connecting one surface of the drum and protruding from a rear surface of the tub, a pulley provided in the rotational shaft and the motor, and a belt connecting the pulley.<

The first water supply part 205 may include a first water supply pipe 205*a* connecting an external water supply source and the first tub 202, and a first water supply valve 205*b* for regulating a flow rate of the first water supply pipe 205*a*.

In addition, the first drain part 206 may include a first drain pipe 206*b* extending from the first tub 202 to an outside of the cabinet 201, and a first drain pump 206*a* providing power to drain water from the first tub 202 and communicating with the first drain pipe 206*b*.

The second treatment unit 300 may include a configuration having the same function as that of the first treatment unit 200, but in a different size.

The second treatment unit 300 may include a second clothing accommodating part 302 and 303 provided inside the second cabinet 301 and provided under the first treatment unit 200. The second accommodating part 302 may include a second tub 302 for storing water, and a second drum 303 rotatably provided in the second tub 302 and accommodating clothes.

The second treatment unit 300 may include a second driving part 304 provided on one surface of the second tub 302 to rotate the second drum 303, a second water supply part 305 for supplying water to the second tub 302, and a second drain part 306 for draining water from the second tub 302.

The second driving part 304 may be coupled to a bottom surface of the second tub 302.

Meanwhile, the first treatment unit 200 may include a first suspension 207 supporting the first tub 202 in the cabinet 201. The first suspension 207 may be provided as a combination of a spring 207*a* and a damper 207*b*, and may be provided as a combination of a bracket and a connecting bar.

The second treatment unit 300 may include a second suspension 307 for supporting the second tub 302 in the second cabinet 301. The second suspension 307 may be provided as a combination of a spring 207*a* and a damper 207*b*, and may be provided as a combination of a bracket and a connecting bar The first suspension 207 and the second suspension 307 may have any shape as long as they can support the first tub 202 and the second tub 302.

When the second treatment unit 300 is provided of a drawer type, a drawer 301*a* to be withdrawn from the second cabinet 301 may be provided, and the second tub 302 and the second drum 303 may be provided inside the drawer 301*a*.

The second driving part 304 includes a second stator 304*a* forming a rotating magnetic field, a second rotor 304*b* provided to be rotatable by the rotating magnetic field, and a second rotational shaft 304*c* connecting the rotor and one surface of the drum.

In addition, it may also be possible for the second driving part 304 to include a motor spaced apart from the second tub 302, a rotational shaft connecting one surface of the drum and protruding from a rear surface of the tub, a pulley provided in the rotational shaft and the motor, and a belt connecting the pulley.

The second water supply part 305 may include a second water supply pipe 305*a* connecting an external water supply source and the second tub 302, and a second water supply valve 305*b* for regulating a flow rate of the second water supply pipe 305*a*.

In addition, the second drain part 306 may include a second drain pipe 306*a* extending from the second tub 302 to an outside of the second cabinet 301, and a second drain pump 306*b* providing power to drain water from the second tub 302 and communicating with the second drain pipe 306*a*.

The first treatment unit 200 may further include a first heater 208 for heating water to the first tub 202 and a first hot air supply part 209 for supplying hot air to the first tub 202.

The first heater 208 is preferably provided under the first tub 202, and a sheath heater may be applied.

Of course, the first heater 208 may have any shape as long as it can heat water in the first tub 202. The first hot air supply part 209 may include a duct for supplying air to the first tub 201, a duct heater provided inside the duct, and a fan for supplying air from the duct to the first tub 202.

The second treatment unit 110 may also include a heater 308 and a hot air supply part 309, as does the first treatment unit 200.

Meanwhile, the first treatment unit 200 and the second treatment unit 300 may include a power supply for supplying power to the first treatment unit 200 and the second treatment unit 300. The power supply may be a switch provided in the first cabinet 201 or the second cabinet 302, and may be preferably provided at one side of the display part 400.

Meanwhile, at least one of the first treatment unit 200 and the second treatment unit 300 may be provided as a drying apparatus. In this case, a treatment unit provided as a drying apparatus out of the first treatment unit 200 and the second treatment unit 300 may have all of the above-described configurations of the water supply part, the drainage unit, the tub, and the heater omitted therein.

Meanwhile, even if the first treatment unit 200 is disposed on the second treatment unit 300, the first treatment unit 200 may be overturned in the second treatment unit 100 due to the center of gravity being concentrated to one point or due to vibration, etc.

In order to prevent the overturn, it is necessary for the first treatment to be stably seated on the second treatment unit 300 even when disposed thereon. In addition, the first treatment unit 200 needs to be seated at an intended position on the second treatment unit 300.

However, the first treatment unit 200 has a considerable volume, and when the first treatment unit 200 is provided as a main laundry treating apparatus, the volume thereof may be significantly larger than that of the second treatment unit 300.

Thus, it is necessary to induce the first treatment unit 200 to be disposed at a correct position in an upper portion of the second treatment unit 300, and to stably fix the first treatment unit 200 to the second treatment unit 300.

To this end, the laundry treating apparatus according to the present disclosure includes a bracket 500 provided between the second cabinet and the first cabinet to support the first cabinet. When the first cabinet 201 is seated on the second cabinet 301, the bracket 500 may guide the first cabinet 201 to be placed at a correct position on the second cabinet 301.

The seating leg 260 may be provided in plural at or near a vertex of a lower surface of the first cabinet 201. The seating leg 260 may maintain and stably support the center of gravity of the first cabinet 201.

The bracket 500 may be provided separately from the second cabinet 301. Alternatively, the bracket 500 may be formed integrally with the second cabinet 301.

Figure 3:
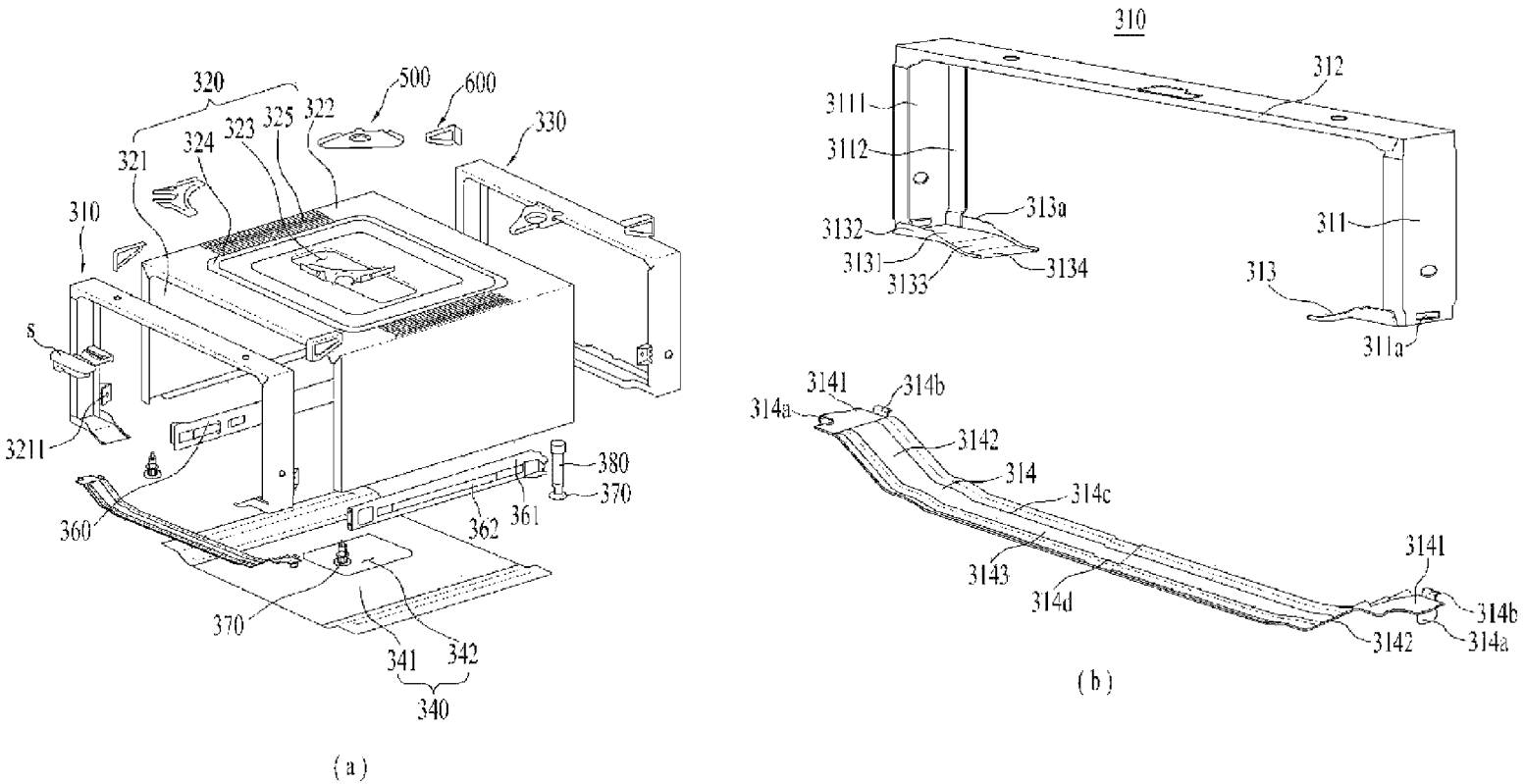
FIG. 3 shows a cabinet structure of a laundry treating apparatus according to the present disclosure.

FIG. 3 is an exploded perspective view of the second cabinet 301.

Referring to FIG. 3(*a*), the second cabinet 301 may include a main body 320 for accommodating the drawer 301*a*, a fixed frame 330 disposed at one side or rear of the main body, and a pull-out frame 310 disposed at the other side or front of the main body to form an opening through which the drawer 301*a* is pulled out from the second cabinet 301.

The pull-out frame 310 may be coupled to the main body 320. The pull-out frame 310 may be coupled to an inner surface of the main body 320. The pull-out frame 310 may support the main body 320. The pull-out frame 310 may be accommodated at the front of the main body 320 and coupled to the main body 320.

The fixed frame 330 may be coupled to the main body 320. The fixed frame 330 may be coupled to the inner surface of the main body 320. The fixed frame 330 may support the main body 320. The fixed frame 320 may be accommodated at the rear of the main body 320 and coupled to the main body 320.

The pull-out frame 310 and the fixed frame 320 may be each provided in a closed curve or a case shape to thereby maintain a shape of the main body 320 and distribute a load applied to the main body 320 mostly to the pull-out frame 310 and the fixed frame 320.

In addition, the pull-out frame 310 and the fixed frame 330 may be each provided with at least one of a thickness or a rigidity stronger than that of the main body 320 to thereby support most of the load applied to the main body 320 and maintain the shape of the main body 320.

Unlike the above description, the pull-out frame 310 may be coupled to the front of the main body 320, and the fixed frame 330 may be coupled to the rear of the main body 320. That is, at least one of the pull-out frame 310 and the fixed frame 330 may be exposed to an outside of the main body 320.

Meanwhile, although the pull-out frame 310 has been described based on an opening formed therein, the opening may be omitted when the second treatment unit 300 is provided as a general top load type rather than a drawer type.

In the main body 320, a space for accommodating the drawer 301*a* or the second clothing accommodating part 302 and 303 may be formed therein.

The main body 320 may be disposed under the first treatment unit 200. The main body 320 may include an upper panel 322 and side panels 321 extending downward from both sides of the upper panel 322. The upper panel 322 may form an upper surface of the second cabinet 301. The side panels 321 may form side surfaces of the second cabinet 301.

The main body 320 may be in a case shape, but may be open at front, rear, and bottom for manufacturing convenience.

The upper panel 322 may include a support groove 323 into which a separate buffer member for maintaining a distance between the second tub 302 and the drawer 301*a* during transportation is inserted. The buffer member inserted into the support groove 323 may extend upward from the upper panel 322 to support the first tub 202 positioned inside the first cabinet 201.

A reinforcement step 324 for reinforcing rigidity of the upper panel 322 may be provided along an outer circumferential surface of the support groove 323. Accordingly, even if a lower surface of the upper panel 322 is not supported by a separate member, the upper panel 322 may be maintained in shape without being bent downward.

A recognition blocking part 325 for generating diffuse reflection may be provided on both surfaces of the upper panel 322. The recognition blocking part 325 is a space in which a separate buffer member is seated in a case where a plurality of second cabinets 201 is stacked during manufacture or transportation. In this case, as the buffer member is seated for a long time, the surface of the second cabinet 201 may be contaminated or stained. In this case, the recognition blocking part 325 may generate diffuse reflection on the surfaces, thereby prevent the contamination or stain from being seen from the outside. In addition, the recognition blocking part 325 may be installed on the upper panel 322, thereby reinforcing the rigidity of the upper panel 322.

Meanwhile, a rail coupling portion 3211, to which a rail 360 with the drawer 301*a* to be pulled in and out there along, can be coupled or fixed may be installed in the pull-out frame 310 and the fixed frame 330.

Accordingly, the pull-out frame 310 and the fixed frame 330 having greater rigidity or durability than that of the main body 320 are capable of fully support the load of the clothing accommodating part.

The rail 360 may include a fixed rail 361 fixed to the rail coupling portion 3211, and a pull-out rail 362 coupled to both side surfaces of the drawer 301*a* so as to be pulled out from the fixed rail 361 toward an opening formed by the pull-out frame 310.

A lower end of the side panel 321 may be bent inwardly to reinforce the rigidity of the side panel 321.

Meanwhile, the second treatment unit 300 may include a support leg 370. The support leg 370 may support a load of the second cabinet 301. The support legs 370 may be coupled to both ends of the side panel 321. Alternatively, the support leg 370 may be coupled to both ends of the fixing rail 361.

The support leg 370 may include a support damper 380 for buffering a transmitted impact. Accordingly, it is possible to absorb the impact that can be transmitted to the ground, thereby preventing propagation of noise. Since the first cabinet 201 is provided of a front-load type and the first driving part 204 is located at a rear surface, the support damper 380 may be installed only in a second support leg 370 located at the rear surface of the main body 320. Accordingly, it is possible to intensively buffer an impact in an area where a vibration occurs.

The fixed frame 330 may be disposed at a rear surface of the main body 320. The fixed frame 330 may be provided in the form of a frame having a C-shaped cross-section. Accordingly, it is possible to secure greater rigidity than that of the main body 320, and to support a load of the first cabinet 201 with the upper surface of the fixed frame 330 or both sides of the upper surface of the fixed frame.

In addition, the fixed frame 330 may be provided in a case shape with only one surface open. That is, the fixed frame 330 may be provided such that only a portion facing the main body 320 or the pull-out frame 310 is opened and one surface away from the main body 320 is shielded.

Accordingly, the fixed frame 330 may form the rear surface of the second cabinet 301, and may prevent the inside of the second cabinet 301 from being exposed to the rear surface.

The second cabinet 301 may include a lower panel 340 disposed under the main body 320. The lower panel 340 may cover at least a portion of a bottom of the cabinet. Due to the lower panel 340, the second driving part 304 or the drawer 301*a* may be prevented from being exposed at the bottom, and the rigidity or shape of the side panel 321 of the main body 320 may be maintained.

Meanwhile, the lower panel 340 may include: a panel body 341 coupled to a bottom of at least one of the main body 320, the pull-out frame 310, and the fixed frame 330; and an open hole 342 for exposing the second driving part 304 or discharging heat generated from the second driving part 304.

Accordingly, it is possible to prevent overheating of the second driving part 304, and to simply repair or installation of the second driving part 304.

The pull-out frame 310 may include a support frame 311 disposed at both front sides of the main body 320, a main frame 312 provided to connect upper ends of the support frames 311 provided on both sides thereof, and an expansion frame 314 coupled to lower ends of the support frames 311 to be aligned with the main frame 312.

The expansion frame 314, the support frame 311, and the main frame 312 may form an opening through which the drawer 301*a* is pulled out. The drawer 301*a* is provided to be pulled out from the pull-out frame 310 through the opening formed by the support frame 311, the main frame 312, and the expansion frame 314.

In this case, since the bottom of the main body 320 is open and the fixed frame 330 is shielded, a height of the drawer 301*a* may be determined by a height of the opening of the pull-out frame 310.

In addition, since the bottom of the second cabinet 302 is spaced apart by a predetermined distance due to the support leg 370, there is an enough space where the pull-out frame 310 is able to further extend downwardly. Thus, the expansion frame 314 may be bent further downward than the lower end of the support frame 311, so that the opening can further expand downwardly.

As a result, a volume of the drawer 301*a* may be expanded, and when the bottom of the drawer 301*a* is opened so that the second driving part 304 protrudes or the bottom of the drawer 301*a* protrudes further downwardly at a position corresponding to the second driving part 304, interference between the second driving part 304 (or the bottom of the drawer 301*a*) and the pull-out frame 310 may also be avoided.

Accordingly, as the internal volume of the drawer 301*a* is expanded, a larger washing capacity and the larger structure of a balancer and suspension part attached to an upper portion of the drum may be installed.

However, when the support frame 311 and the expansion frame 314 are integrally provided, bending the bottom of the drum 301*a* downwardly by deforming the expansion frame 314 cannot overcome the plastic deformation of the material and thus a rate of expansion may be limited.

Therefore, the increased washing capacity may not be sufficient, and there may be insufficient space for a balancer and a suspension structure to be installed.

In the laundry treating apparatus of the present disclosure, the expansion frame 314 may be provided separately from the support frame 311 and the expansion frame 314 may be bent downward.

Accordingly, the expansion frame 314 may be of a material having a greater degree of plastic deformation than that of the support frame 311. In addition, compared to a case where the expansion frame 314 is formed integrally with the support frame 311, the expansion frame 314 may be bent further wider and downward. Thus, the opening of the pull-out frame 310 may be further expanded, and accordingly, a height of the drawer 301*a* to be pulled out may be further expanded.

Therefore, the height of the second tub 302 may be higher, and accordingly, a larger balancer to be coupled to the top of the second drum 303 may be installed or a larger installation space of the second suspension 307 may be secured, so that a complex structure can be sufficiently installed.

The expansion frame 314 may be coupled to a lower end of the support frame 311. A seating portion 313 bent at the lower end of the support frame 311 and disposed below the lower end of the support frame 311 may be provided at a bottom of the support frame 311.

The expansion frame 314 may be coupled to a top of the seating portion 313. Due to the seating portion 313, the expansion frame 314 may be able to be completely coupled to the support frame 311 even if the material of the expansion frame 314 is soft or a downward bending amount of the expansion frame 314 is larger.

The seating portion 314 may extend from the lower end of the support frame 311 in parallel with the main frame 312. Thus, a length of the expansion frame 314 may be reduced within a length range in which the seating portion 313 is extended. In addition, it is possible to secure a greater bending amount for the expansion frame 314 to be deformed downward.

A space A (see FIG. 4) may be formed between the expansion frame 314 and the seating portion 313. Hereinafter, the space A may be referred to as a separation space A. At least a portion of the expansion frame 314 may be spaced apart from and coupled to the seating portion 313 to form a separation space A. The expansion frame 314 may be coupled to the support frame 311 at the bottom of the pull-out frame 310, so that the separation space A is secured.

Meanwhile, at the front of the pull-out frame 310 or the main body 320, a sensor S for detecting whether the drawer 301*a* is pulled out or whether a second door for opening and closing a loading port of the second tub 302 is opened or closed may be installed.

In addition, a frame support part 600 for guiding the pull-out frame 310 and the fixed frame 330 to be coupled to the main body 320 may be further installed.

The frame support part 600 may be provided at each corner of the main body 320 to provide a structure to be coupled to the pull-out frame 310 and the fixed frame 330. In addition, the frame support part 600 may provide a structure in which the bracket 500 supporting the seating leg 260 of the first cabinet 201 is coupled.

Referring to FIG. 3(*b*), in the pull-out frame 310, the seating portion 313 on which the expansion frame 314 is seated may be manufactured integrally with the support frame 311.

The seating portion 313 may extend from a lower portion of the support frame 311 provided on both sides, so that both ends of the expansion frame 314 can be seated therein. The seating portion 313 may extend inwardly from the lower portion of each of the both support frames 311 to support a bottom surface of the expansion frame 314.

The seating portion 313 may be provided not only to support the load of the expansion frame 314, but also serves to fix the expansion frame 314 to prevent the installation position of the expansion frame 314 from being changed.

The seating portion 313 may extend from the bottom of the support frame 311 in parallel with the ground. Alternatively, a free end of the seating portion 313 may extend to be positioned further lower than a lower end of the support frame 311. Accordingly, an area of the opening formed by the lead frame 310 may be further enlarged.

The seating portion 313 may include an extension panel 3131 extending from the bottom of the support frame 311, and bent ribs 3132 bent upward from both sides of the extension panel 3131 to form a space where the expansion frame is installed or the separation space A.

The expansion frame 314 may be fixed to the bent ribs 3132. The expansion frame 314 may be fixed to the inside of the bent ribs 3132.

The expansion frame 314 may include a seating body 3141 disposed between the bent ribs 3132 provided on both sides. The seating body 3141 may be at least partially spaced apart from the seating portion 313 to form the separation space A.

The seating body 3141 may include a support protrusion 314*b* extending from at least one of both side surfaces thereof to a bent rib 3132 and then coupled to or seated on the bent rib 3132.

The support protrusion 314*b* may arrange the seating body 314 on the bent rib 3132 so that the seating body 314 and the extension panel 3131 are spaced apart from each other. Thus, even if the seating body 314 is seated on the bent rib 3132, the separation space A may be formed between the extension panel 3131 and the seating body 314.

Even if the seating body 3141 is spaced apart from the extension panel 3131, the support protrusion 314*b* may be coupled to or seated on the bent rib 3132 to fix the installation position of the seating body 3141. The bent rib 3132 may include a seating groove 313*a* in which the support protrusion 314*b* can be supported. Thus, at least a portion of an outer surface of the support protrusion 314*b* may be brought into contact with an inner circumferential surface of the seating groove 313*a* or accommodated in the seating groove 313*a*, so that the seating body 3141 can be disposed and installed at a correct position.

The expansion frame 314 may include an insertion protrusion 314*a* extending from the seating body 3141 to fix the seating body 3141 to the seating portion 313 or the support frame 310.

The insertion protrusion 314*a* may pass through the support frame 310 or the seating portion 313 to fix the seating body 3141.

For example, the support frame 310 may include an insertion hole 311*a* into which the insertion protrusion is inserted and coupled.

The insertion hole 311*a* may be spaced apart from the extension panel 3131 by a predetermined distance. Thus, as the insertion protrusion 314*a* of the seating body 3141 is inserted into the insertion hole 311*a*, the seating body 3141 may be installed at the bent rib 3132 while being spaced apart from the extension panel 3131.

The support frame 311 may further include a support panel 3111 disposed at front of both sides of the main body 320, and a reinforcement panel 3112 bent and extending at both ends of the support panel 3111.

The insertion hole 311*a* may be formed in the support panel 3111.

The support panel 3111 may form a part of a side surface of the second cabinet 301 or may be disposed inside the main body 320.

The reinforcement panel 3112 may be bent and extend from the support panel 3111 to reinforce the rigidity of the support frame 311, and may be supported by being in contact with a front bent portion of the main body 320.

The support protrusion 314*b* may extend from a free end of the expansion frame 314 and be then inserted into the insertion hole 311*a* provided in the support panel 3111.

The insertion protrusion 314*a* may protrude outward from a free end of the seating body 3141, and the support protrusion 314*b* may extend at a position corresponding to an inclined direction or a vertical direction with respect to the direction in which the insertion protrusion 314*a* of the seating body 3141 protrudes.

Thereby, the positions of the support protrusion 314*b* and the insertion protrusion 314*a* may be separated, preventing an operator from confusing the components in assembling.

The insertion hole 311*a* may be spaced apart from the seating portion 313 by a height of the separation space A. Accordingly, when the insertion protrusion 314*a* is inserted into the insertion hole 311*a*, the separation space A may be formed between the seating body 3141 and the seating portion 313.

Meanwhile, the expansion frame 314 may be provided with a reinforcement bead 314*c* capable of reinforcing the rigidity of the expansion frame 314 in a longitudinal direction. The reinforcement bead 314*c* may be formed after the expansion frame 314 is inclined downwardly.

Furthermore, the expansion frame 314 may further include an avoiding groove 314*d*, so that interference with the second driving part 304 or a bottom surface of the drawer 301*a* accommodating the second driving part 304 can be avoided.

The avoiding groove 314*d* may extend along a thickness direction of the expansion frame 314 and may be provided in a downwardly recessed shape.

The avoiding groove 314*d* may be provided in an expansion body 3143 to avoid the second driving part 304 or a lowermost end of the drawer 301*a*.

The expansion frame 314 may be provided symmetrically. Thus, the seating body 3141 may be provided on both sides of the expansion frame 314, and the insertion protrusion 314*a* and the support protrusion 314*b* may also be provided on both sides of the expansion frame 314.

The expansion frame 314 may be provided such that a center is lower than both ends.

The expansion frame 314 may be provided in a shape extending from one end to the other end, bent downward, and then bent upward again.

Thus, the expansion frame 314 may further expand the area of the opening of the pull-out frame 310 downward.

The seating portion 313 may further include an expansion panel 3133 bent downward from the seating body 3131. The expansion panel 3133 may contribute to positioning the free end of the seating portion 313 lower than the support frame 311. The expansion panel 3133 may extend obliquely downward from the free end of the seating body 3131.

In addition, the seating portion 313 may further include a seating panel 3134 extending from the expansion panel 3133 to support the expansion frame 314. The seating panel 3134 may stably support the expansion frame 314 by expanding a contact area with the expansion frame 314.

Meanwhile, the expansion frame 314 may include an inclined body 3142 extending obliquely downward from the seating body 3141, and an expansion body 3143 extending from the inclined body 3142 to face the main frame 312.

The inclined body 3142 and the seating body 3141 may be provided symmetrically with respect to the expansion body 3143.

The bent ribs 3132 may extend from both side surfaces of the extension panel 3131 to both side surfaces of the expansion panel 3133. The bent ribs 3132 may be provided to fix the inclined body 3142.

In addition, the bent ribs 3132 may extend to both side surfaces of the seating panel 3134.

A height of a bent rib 3132 provided in the seating panel 3134 may be greater than a height of a bent rib 3132 provided in the expansion panel 3133 or the seating panel 3134.

Alternatively, the bent rib 3132 may be provided from the seating panel 3134 to the expansion panel 3133. Or the bent rib 3132 may be provided at the seating panel 3134.

In addition, the space A between the expansion frame 314 and the seating portion 313 may become narrower from the seating body 3141 to the inclined body 3142. That is, the inclined body 3142 may extend obliquely toward the expansion panel 3133, so that a thickness of the separation space A in the seating body 3141 becomes narrower.

Accordingly, pulling out the drawer 301*a* may not be disturbed.

In addition, the fixed frame 330 may have the same structure as that of the lead frame 310, except that the opening is not formed. That is, the fixed frame 330 may also include the support frame 311, the seating portion 313, and the expansion frame 314 to form the space A therein.

Furthermore, if the second cabinet 301 is disposed on the first treatment unit 200 or is disposed independently of the first treatment unit 200, the main body 320 may be provided to provide a space to accommodate the clothing accommodating part 302 and 303.

In this case, the lead frame 310 may be provided to form the separation space A, but may not form an opening like the fixed frame 330.

Figure 4:
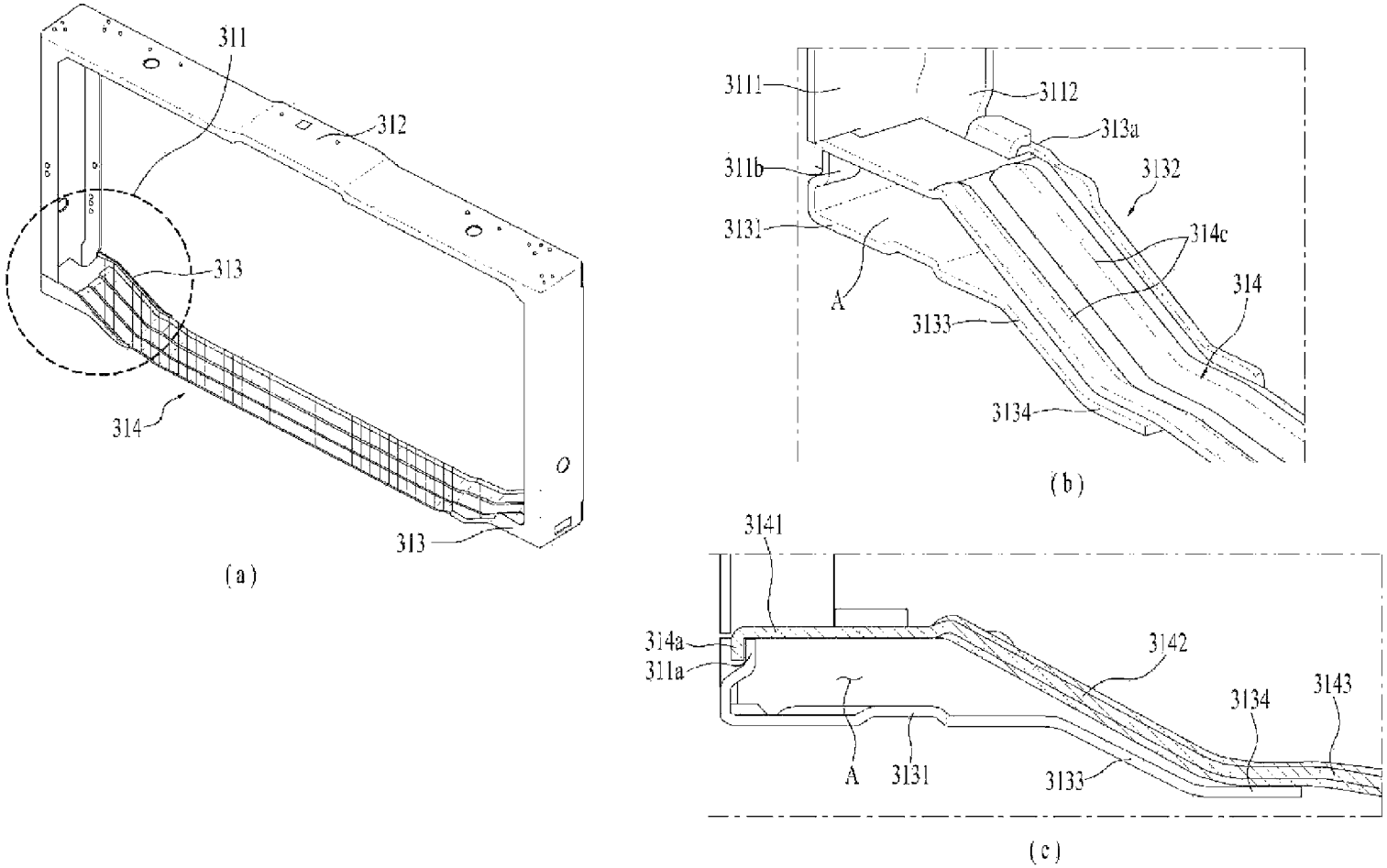
FIG. 4 is a view showing a structure of a front frame of a laundry treating apparatus according to the present disclosure.

FIG. 4 shows the separation space A of the pull-out frame.

Referring to FIG. 4(*a*), the expansion frame 314 may be seated and coupled to the seating portion 313.

Both ends of the expansion frame 314 may be accommodated and coupled to the seating portion 313 and the bent rib 3132, and a central portion of the expansion frame 314 may be located lower than the lower portion of the support frame 311.

Referring to FIGS. 4(*b*) and 4(*c*), the support panel 3111 may receive a receiving groove 311*b* recessed from an outer circumferential surface of the insertion hole 311*a* toward the opening so that a free end of the insertion protrusion 314*a* can be accommodated.

The receiving groove 311*b* may be recessed inwardly from the support panel 3111, and may be recessed deeper at a thickness greater than a thickness of the insertion protrusion 314*a*.

Thus, the insertion protrusion 314*a* may be inserted into the insertion hole 311*a* and then bent to be seated or accommodated in the receiving groove 311*b*. Accordingly, the expansion frame 314 and the seating portion 313 may be coupled and fixed by themselves without an additional fastening member.

Meanwhile, the support protrusion 314*b* may protrude upward from the seating body 3141 and be then bent in a direction away from the seating body 3141. Accordingly, the seating body 3141 may be accommodated and supported in the bent rib 3132.

The inclined body 3142 may extend obliquely from the seating body 3141 so that a distance from the extension panel 3131 or the expansion panel 3133 becomes closer. In other words, the space A between the seating portion 313 and the expansion frame 314 may become smaller in a direction in which the expansion frame 314 is spaced apart from the seating portion 313.

As a result, the separation space A may be gradually narrowed, and the expansion frame 314 may be bent obliquely downward.

Accordingly, due to the separation space A, it is possible to secure the rigidity or durability of the pull-out frame 310, also not to intervene the drawer 301*a* from being pulled out.

In addition, at least one of the inclined body 3142 and the expansion body 3143 comes into contact with the seating panel 3134. Thus, the expansion frame 314 may be supported by being physically in surface contact with the seating portion 313 even if the space A separated from the seating portion 313 is present.

In addition, at least one of the inclined body 3142 and the expansion body 3143 may be coupled to the seating panel 3134 by welding or a fastening member and fixed thereto. Thus, even if the expansion frame 314 is provided separately from the seating portion 313, the same effect may be derived as if the expansion frame 314 is provided integrally.

Meanwhile, the reinforcement bead 314*c* may be provided in at least one of the seating body 3141, the inclined body 3142, and the expansion body 3143. That is, the reinforcement bead 314*c* may be provided by protruding from or being recessed in at least one of the seating body, the inclined body, and the expansion body.

For example, the reinforcement bead 314*c* may extend in a longitudinal direction of the inclined body 3132 and the expansion body 3143. In addition, a reinforcement beads 314*c* may be provided in plural such that a plurality of reinforcement beads is spaced apart from each other by a predetermined distance along a thickness direction of the inclined body 3142 and the expansion body 3143. Accordingly, even if the expansion frame 314 is of a material with high ductility but low rigidity, itis possible to secure sufficient durability.

Figure 5:
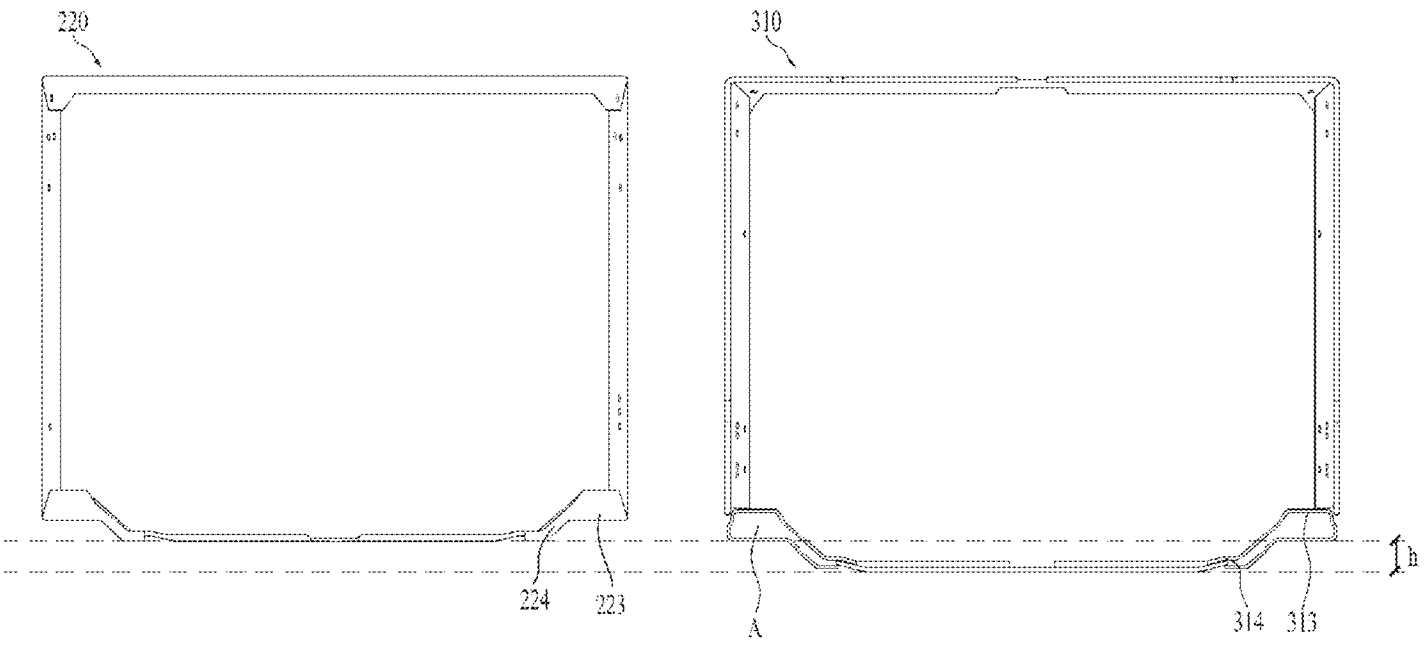
FIG. 5 is a view showing the effect of a laundry treating apparatus of the present disclosure.

FIG. 5 shows an effect of increasing a volume of a laundry treating apparatus according to the present disclosure.

FIG. 5(*a*) shows a front frame 220 of a conventional laundry treating apparatus, and FIG. 5(*b*) shows a pull-out frame 310 of a laundry treating apparatus according to the present disclosure.

Referring to FIG. 5(*a*), since the front frame 220 of the conventional laundry treating apparatus is integrally provided, the front frame 220 has a limit in the length to extend even when bent downward.

In other words, even if a lowermost end of the lower frame 223 is further extended downward by bending a portion of the lower frame 223 to form the extension bent portion 224, a length of the extension bent portion 224 to be bent is inevitably limited due to limitation of the plastic deformation.

Thus, a maximum area of an opening that can be formed by the front frame 220 of the conventional laundry treating apparatus is limited, and a height of a clothing receiving part is also limited, and therefore, it is not possible to secure a washing capacity equal to or greater than a certain level.

In addition, since the lower frame 223 and the extension bent portion 224 do not form the separation space A therein, the cross section is provided in an "L" shape or "C" shape. Thus, only vibrations corresponding to an extending direction of the lower frame 223 are absorbed or dissipated among vibrations generated in the clothing accommodating part, except for vibrations in other directions.

Thus, the front frame 220 of the conventional laundry treating apparatus has a problem in that it does not guarantee durability in terms of noise and vibration and durability as well as a limited washing capacity.

Referring to FIG. 5(*b*), since the pull-out frame 310 of the laundry treating apparatus of the present disclosure is coupled in a state in which the expansion frame 314 and the seating portion 313 are separated from each other, an amount of plastic deformation of the expansion frame 314 and the seating portion 313 may be further increased.

Thus, by plastically deforming both the seating portion 313 and the expansion frame 314, the expansion frame 314 may be spaced apart further longer by h from the main frame 312.

As a result, the opening of the pull-out frame 310 may be further expanded to increase the height of the clothing accommodating part 302 and 303, and a washing capacity may be further secured.

Meanwhile, the expansion frame 314 and the seating portion 313 may form the separation space A therein, and the separation space A may have a cross section of a two-dimensional figure (for example, a polygon with more sides than a quadrangle).

Due to the separation space A, a load transferred to the seating portion 313 and the expansion frame 314 may be distributed to greatly increase the durability of the pull-out frame 310 itself.

Furthermore, a vibration transmitted in various directions (e.g., a width direction, a height direction, a front-rear direction, etc.) transmitted to the pull-out frame 310 may be supported by the entire separation space A.

In other words, the separation space A formed between the expansion frame 314 and the seating portion 313 serves to attenuate or dissipate noise or vibration transmitted to the pull-out frame 310 to a certain level.

The noise or vibration transmitted to the pull-out frame 310 may be dissipated to a certain level in the separation space A. Thus, even if the expansion frame 314 and the seating portion 313 are spaced apart from the ground, an amplitude of vibration may be greatly reduced when the vibration is transmitted.

In addition, a vibration transmitted to the extension frame 310 may be prevented from being transmitted to the expansion frame 314 as it is, so that the rigidity or durability of the expansion frame 314 can be secured and the expansion frame 314 may not generate noise and vibration.

In addition, an impact transmitted to the pull-out frame 310, for example, in a process in which the drawer 301*a* is pulled out, may be dissipated by the separation space A.

In addition, the pull-out frame 310 may distribute a transmitted load through the separation space A. Accordingly, by installing the separation space A in the expansion frame 314 and the seating portion 313, which receive the most load of the laundry treating apparatus, it is possible to sufficiently secure the overall durability of the pull-out frame 310.

In addition, the vibration transmitted to the separation space A may be dissipated in various directions along one surface of the expansion frame 314 and the seating portion 313.

As a result, seismic resistance of the pull-out frame 310 may be greatly increased.

Meanwhile, an earthquake-resistant effect may be applied even if the laundry treating apparatus of the present disclosure is not provided as a drawer type.

Figure 6:
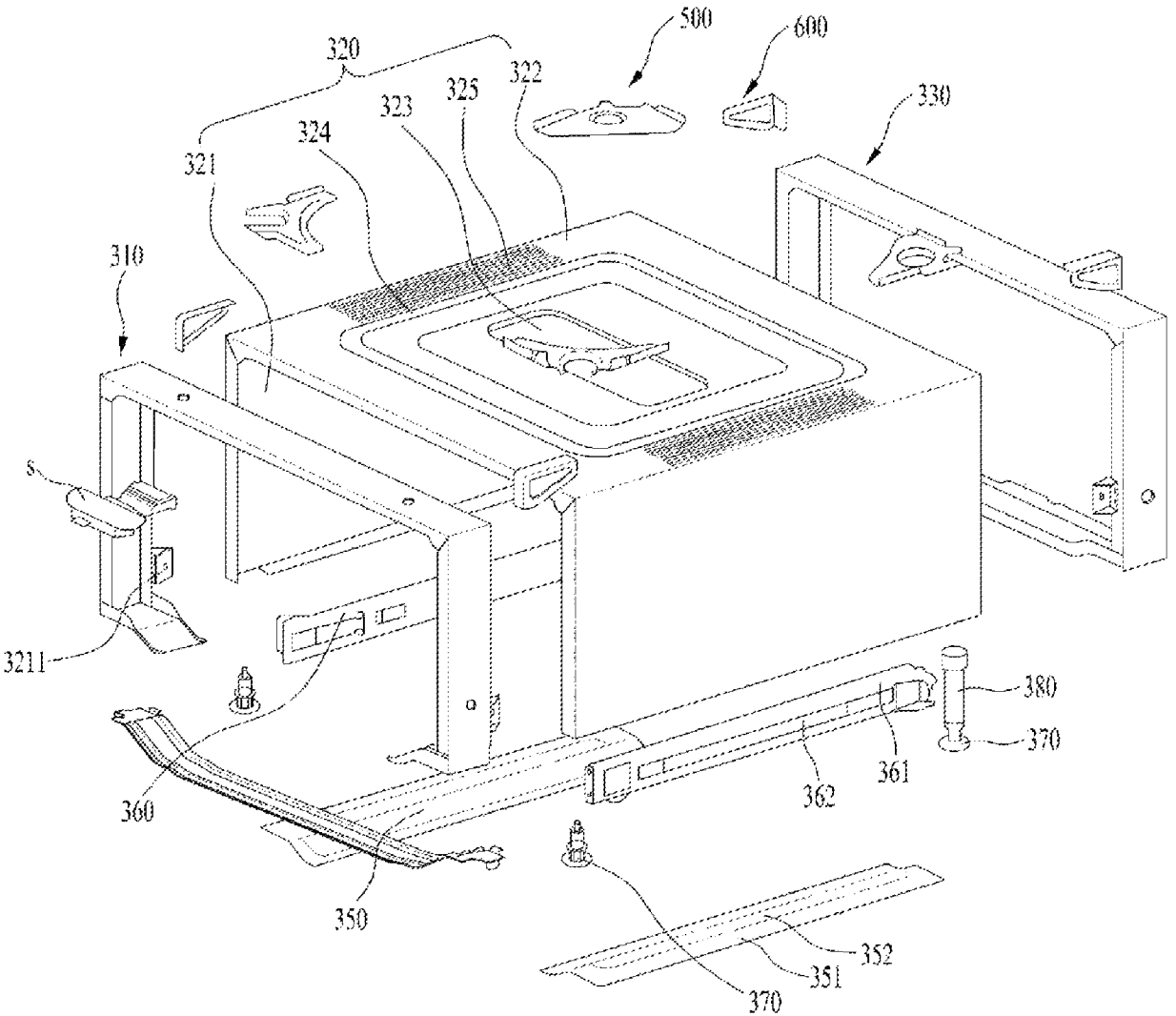
FIG. 6 shows another example of a cabinet of a laundry treating apparatus according to the present disclosure.

FIG. 6 shows another example of a second cabinet of a laundry treating apparatus according to the present disclosure.

In the second cabinet of FIG. 6, the lower panel 340 shown in FIG. 3 may be replaced with the lower frame 350.

Specifically, the laundry treating apparatus according to the present disclosure may include the lower frame 350, which is coupled to one lower corner of one side of at least one of the main body 320, the fixed frame 330, and the pull-out frame 310, and coupled to a lower end of the other side of at least one of the main body 320, the fixed frame 330, and the pull-out frame 310, the other side facing the one side.

That is, the lower frame 350 may extend along a longitudinal direction under the main body 320.

Both ends of the lower frame 350 may extend from the bottom of the main body 320 to the pull-out frame 310 and the fixed frame 330 and be coupled thereto.

Accordingly, the lower frame 350 may induce the pull-out frame 310 and the fixed frame 330 to be coupled to the main body 320.

The lower frame 350 may include a frame body 351 defining the main body, and a frame bead 352 provided concave or convex inside the frame body 351 to reinforce the rigidity of the frame body.

The frame body 351 may be bent downward along an inclination of the seating portion 313 or the expansion frame 314 in a direction inwardly from an outer surface of the second cabinet 301.

Accordingly, it is possible to prevent contact with the drawer 301*a* or the second driving part 304.

Figure 7:
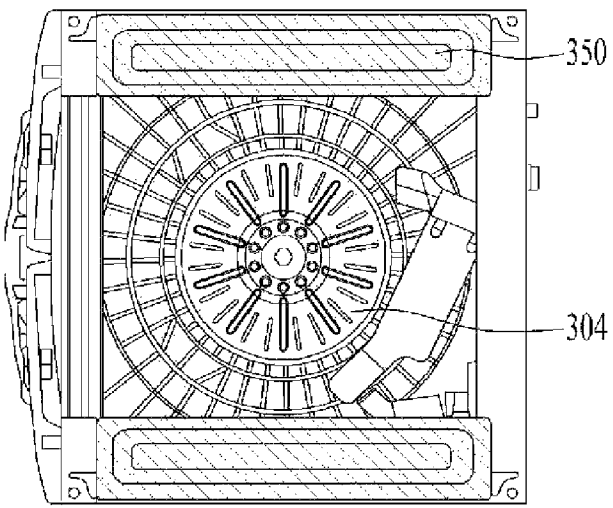
FIG. 7 shows an additional effect of the laundry treating apparatus of the present disclosure.
Figure 7:
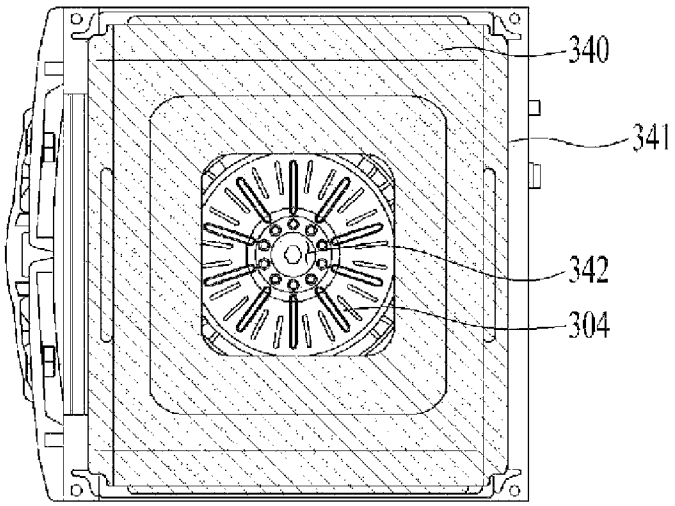

FIG. 7 is a view showing an effect according to a change in the installation structure of the second cabinet 301.

Referring to FIG. 7(*a*), the lower panel 340 may be coupled to the bottom of the second cabinet 301.

The panel body 341 of the lower panel 340 may include an avoiding groove for avoiding a space in which the support leg 370 can be installed at each corner. The lower panel 340 may be provided with a driving open hole 342 that exposes a space in which the driving part 304 is installed inside the driving part 304 or the drawer 301*a*.

Accordingly, heat irradiated from the driving part 304 may be discharged to the outside of the second cabinet 302.

In addition, a support member for separately supporting the driving part 304 may be inserted into the driving open hole 342. Thus, the support member may support the driving part 304 during transportation, thereby preventing damage to the internal structure of the second cabinet 302.

Meanwhile, referring to FIG. 7(*b*), the lower frame 350 may be provided with a thickness that can prevent overlapping with the bottom of the driving part 304.

That is, the lower frame 350 may connect both sides of the second cabinet 302 to maintain the rigidity and shape of the main body 320, but induce the entire diameter of the driving part 304 to be exposed downward.

Thus, as all of the heat generated by the driving part 304 is irradiated to the outside, the driving part 304 may be cooled and it may be advantageous when repairing and replacing components installed inside the second cabinet 301, such as the drawer 301*a*.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus comprising:

a first cabinet having an upper panel and a side panel extending downward from an edge of the upper panel;

a first tub disposed in the first cabinet;

a first drum rotatably disposed in the first tub;

a first driver disposed below the first tub and fixed to a bottom of the first tub, the first driver having a first driving shaft extending through the bottom of the first tub, and the first driving shaft being fixed to the first drum; and a front frame coupled to a front of the first cabinet, the front frame including:

an upper frame extending in a widthwise direction of the first cabinet;

a pair of support frames extending downward from opposite ends of the upper frame;

a lower frame extending along a longitudinal direction of the upper frame, opposite ends of the lower frame being coupled to the support frames at a position spaced upward from lower ends of the support frames; and seating portions extending from the lower ends of the support frames toward a center of the front frame in the widthwise direction of the first cabinet, wherein separation spaces are defined between the opposite ends of the lower frame and the seating portions.

2. The laundry treating apparatus of claim 1, wherein each seating portion includes extension ribs extending upward from front and rear edges of the seating portions, and wherein the lower frame is coupled to the extension ribs.

3. The laundry treating apparatus of claim 2, wherein each seating portion further includes a seating groove recessed downward from each extension rib, and wherein the lower frame includes support protrusions protruding from a lower groove, the support protrusions being inserted into the seating grooves.

4. The laundry treating apparatus of claim 3, wherein each support frame includes an insertion hole spaced upward from the lower end of the support frame, and wherein the lower frame further includes insertion protrusions protruding from the lower frame, the insertion protrusions being inserted into the insertion holes of the support frames.

5. The laundry treating apparatus of claim 4, wherein each support frame further includes a receiving groove recessed in an outer surface of the support frame, the receiving groove being disposed below the insertion hole, and wherein the insertion protrusions of the lower frame extend downward to be disposed in the receiving grooves of the support frames.

6. The laundry treating apparatus of claim 1, wherein each support frame includes an insertion hole spaced upward from the lower end of the support frame, and wherein the lower frame includes insertion protrusions protruding from the lower frame, the insertion protrusions being inserted into the insertion holes of the support frames.

7. The laundry treating apparatus of claim 6, wherein each support frame further includes a receiving groove recessed in an outer surface of the support frame, the receiving groove being disposed below the insertion hole, and wherein the insertion protrusions of the lower frame extend downward to be disposed in the receiving grooves of the support frames.

8. The laundry treating apparatus of claim 1, further comprising a reinforcement bead extending along a longitudinal direction of the lower frame.

9. The laundry treating apparatus of claim 1, wherein the lower frame comprises an inclined part inclined downwardly toward the center of the front frame in the widthwise direction of the first cabinet.

10. The laundry treating apparatus of claim 9, wherein the lower frame further comprises an expansion part extending from the inclined part in a longitudinal direction of the lower frame.

11. The laundry treating apparatus of claim 10, further comprising a pair of support legs located below the first cabinet, wherein the expansion part is positioned between the pair of support legs in the widthwise direction of the first cabinet.

12. The laundry treating apparatus of claim 9, further comprising a drawer disposed in the first cabinet, the drawer being configured to be drawn out through an opening defined by the front frame, and the drawer accommodating the first tub and the first driver.

13. The laundry treating apparatus of claim 12, wherein the lower frame includes an avoiding groove disposed at a position corresponding to the first driving shaft in the widthwise direction of the first cabinet.

14. The laundry treating apparatus of claim 1, further comprising:

a second cabinet disposed above the first cabinet;

a second tub disposed in the second cabinet;

a second drum rotatably disposed in the second tub; and a second driver fixed to the second tub, the second driver having a second driving shaft extending through the second tub, and the second driving shaft being fixed to the second drum.

15. The laundry treating apparatus of claim 14, further comprising legs extending down from the second cabinet, the legs being supported by the upper panel of the first cabinet.

16. The laundry treating apparatus of claim 15, further comprising a drawer disposed in the first cabinet, the drawer being configured to be drawn out through an opening defined by the front frame, and the drawer accommodating the first tub and the first driver.

17. The laundry treating apparatus of claim 16, wherein the lower frame includes an avoiding groove disposed at a position corresponding to the first driving shaft in the widthwise direction of the first cabinet.

18. The laundry treating apparatus of claim 14, wherein each seating portion includes extension ribs extending upward from front and rear edges of the seating portions, and wherein the lower frame is coupled to the extension ribs.

* * * * *